US006960047B2

(12) United States Patent
Knezek et al.

(10) Patent No.: US 6,960,047 B2
(45) Date of Patent: Nov. 1, 2005

(54) PROTECTION BARRIER APPARATUS

(75) Inventors: Erick B. Knezek, Annapolis, MD (US); Matthew A. Marcy, Annapolis, MD (US); Robert C. Truston, Seaford, VA (US)

(73) Assignee: Innovative Technology Application, Inc., Springfield, VA (US)

( * ) Notice: Subject to any disclaimer, the term of this patent is extended or adjusted under 35 U.S.C. 154(b) by 0 days.

(21) Appl. No.: 10/621,655

(22) Filed: Jul. 18, 2003

(65) Prior Publication Data

US 2004/0018060 A1 Jan. 29, 2004

Related U.S. Application Data

(60) Provisional application No. 60/400,130, filed on Aug. 2, 2002.

(51) Int. Cl.[7] ..... B63G 9/00

(52) U.S. Cl. ..... 405/211; 405/35; 114/241; 114/240 C

(58) Field of Search ..... 405/211, 212; 114/240 R, 241, 240 A, 240 C, 240 E

(56) References Cited

U.S. PATENT DOCUMENTS

| | | | | | |
|---|---|---|---|---|---|
| 1,249,107 | A | * | 12/1917 | Johnson | 114/241 |
| 1,353,811 | A | * | 9/1920 | Muncy | 114/240 E |
| 1,418,332 | A | * | 6/1922 | Schweiger | 256/73 |
| 1,856,841 | A | * | 5/1932 | McDonald | 256/3 |
| 2,369,464 | A | | 2/1945 | Kalnitz | |
| 3,101,491 | A | * | 8/1963 | Salo | 441/23 |
| 3,952,521 | A | | 4/1976 | Potter | |
| 4,562,785 | A | | 1/1986 | Priam-Doizi | |
| 4,776,724 | A | * | 10/1988 | Isozaki | 405/27 |
| 4,961,393 | A | | 10/1990 | Murray | |
| 6,003,458 | A | | 12/1999 | Valliere | |
| 6,591,774 | B2 | * | 7/2003 | Metherell et al. | 114/241 |
| 6,669,403 | B2 | * | 12/2003 | Clark et al. | 405/30 |
| 6,681,709 | B1 | * | 1/2004 | Nixon et al. | 114/241 |
| 2003/0051652 | A1 | | 3/2003 | Metherell et al. | |
| 2003/0136325 | A1 | | 7/2003 | Wooley et al. | |

FOREIGN PATENT DOCUMENTS

| | | |
|---|---|---|
| DE | 2537739 | 3/1977 |
| DE | 19635824 | 3/1998 |
| GB | 1136333 | 12/1968 |
| GB | 2375739 | 11/2002 |

OTHER PUBLICATIONS

Duane Davis et al., "Waterside Lightweight Barrier Project," Technical Report, TR–2027–SHR, Naval Facilities Engineering Service Center, Port Hueneme, CA, pp. 1–46, A–1 through A–24, B–1 through B–18; Sep. 1994.

* cited by examiner

*Primary Examiner*—Jong-Suk (James) Lee

(57) ABSTRACT

A protection apparatus protects a harbor or an area in a body of water or adjacent to a body of water. The protection apparatus floats on the body of water, and includes a plurality of barrier units positioned side-by-side, each of the barrier units includes a composite-based durable barrier structure. The barrier structure is configured to hold a net in place in order to protect an area in the body of water or abutting the body of water from waterborne craft. The protection apparatus also includes connectors respectively provided between adjacently-positioned ones of the barrier units. Each of the connectors includes a tensile member and a dampening member for handling forces applied to the protection barrier and for maintaining the integrity of the protection barrier.

7 Claims, 8 Drawing Sheets

PROTECTION BARRIER APPARATUS

CROSS REFERENCE TO RELATED APPLICATIONS

This application claims priority from provisional application Ser. No. 60/400,130, filed on Aug. 2, 2002, entitled "ITA Harbor Protection Barrier", by the same inventors as this application.

BACKGROUND OF THE INVENTION

A. Field of the Invention

The invention relates generally to protection barriers and, more particularly, to durable, lightweight floating barriers that are used to protect areas such as harbors, water regions, or other types of land or water areas from high speed water craft attack.

B. Description of the Related Art

In the current environment with terrorist activities on the rise, there is a need to protect assets from terrorist attacks. One type of protection device is a floating harbor protection barrier system designed to provide protection to military and commercial harbors from high speech surface boat attacks.

Initial research into harbor protection by the Naval Facilities Engineering Service Center led to the development of a mostly-steel structure called the Port Security Barrier. The Port Security Barrier consists of three steel pontoons supporting a steel box beam, steel supports for netting, steel braces, and primary netting made up of 1.125 inch diameter nylon 12-plait line with a mesh size of one foot.

Another type of floating barrier device is described in the Naval Facilities Engineering Service Center Technical Report TR-2027-SHR, dated September, 1994 (hereinafter referred to as "Technical Report"). As described in the Technical Report, a lightweight floating barrier for defeating a high speed boat attack includes at least one 40-foot-long barrier module with a lightweight glass reinforced plastic (GRP) frame, low density closed cell foam floats, and a capture net woven from high strength Spectra™ line. Each barrier module can be folded for ease in transportation between locations, and assembly and installation of a lightweight floating barrier can be done with unskilled labor using simple tools and support craft.

While the use of GRP for components of a harbor protection barrier is an improvement over the use of a mostly-steel or an all-steel construction for a harbor protection barrier in some respects (e.g., lower maintenance costs), it still has problems associated with not being as structurally strong as the mostly-steel construction, and thereby it does not provide as good a protection or durability as one would get from the mostly-steel construction or all-steel construction of a harbor protection barrier. For example, a test described in the Technical Report (see FIG. 29 of the Technical Report) shows that a GRP protection barrier frame was shattered by a high-speed boat impacting the GRP protection barrier. One can surmise from that test that boats following a lead boat (which impacted the GRP protection barrier) may be able to follow the same path in the water as the lead boat and thereby penetrate into a region protected by one or more GRP protection barriers, which is clearly undesirable.

Furthermore, conventional GRP Port Security barrier modules are not particularly sturdy with respect to dealing with forces due to boat attacks and/or forces due to severe weather conditions.

Also, for an all-steel construction or for a mostly-steel construction of a Port Security barrier, there is a problem in that maintenance costs are very high. For example, when the Port Security barrier is floating in the water, it deteriorates over time due to the sea water that comes in contact with the steel. This leads to rusting, which causes deterioration of the Port Security barrier, thereby making it less structurally sound. While such steel-constructed Port Security barriers typically have a paint coat to partially counter the rusting problem, the conventional Port Security barriers have to be painted fairly often in order to maintain the structural integrity of the paint barrier, which again results in high maintenance costs.

Furthermore, with conventional Port Security barriers, there is a problem associated with coupling two or more harbor protection barrier modules together to protect a large region, such as a harbor. As described in the Technical Report, each protection barrier module is 40 feet long, and thus to protect a length of harbor of 150 feet would require four (4) protection barrier modules coupled together. The conventional method of coupling protection barrier modules to each other is via a loose coupling at the respective ends of adjacent protection barrier modules, typically by coupling a steel cable to respective ends of adjacent protection barrier modules. This loose coupling results in undesired stresses being imparted to individual protection barrier modules as they flop around in the water due to inclement weather conditions such as high wave and high wind conditions. Such a loose coupling between protection barrier modules may result in damage to individual protection barrier modules, with results in an undesired cost associated with repairing protection barrier modules already installed or having to utilize new protection barrier modules to replace protection barrier modules that are damaged beyond repair.

The present invention is directed to overcoming or at least reducing the effects of one or more of the problems set forth above, such as to provide a sturdy harbor protection barrier structure that can withstand hurricane force winds and that does not require much upkeep

SUMMARY OF THE INVENTION

According to one embodiment of the invention, there is provided a protection apparatus that is configured to float on a body of water, and which includes a composite-based durable barrier structure, the barrier structure configured to hold a net in place, the protection apparatus configured to protect an area in the body of water or abutting the body of water from waterborne craft.

According to another embodiment of the invention, there is provided a connector for a protection barrier system that includes a plurality of protection barrier units with adjacent ones of the protection barrier units coupled to each other by way of the connector. The connector includes a tensile member configured to couple to the adjacent protection barrier units and to accept and dissipate a tensile force provided from the adjacent protection barrier units. The connector also includes a dampening member disposed around the tensile member and configured to accept and dampen a dampening force provided from the adjacent protection barrier units.

According to yet another embodiment of the invention, there is provided a protection apparatus that is configured to float on a body of water. The protection apparatus includes a plurality of barrier units positioned side-by-side, each of the barrier units comprising a composite-based durable barrier structure, the barrier structure configured to hold a net in place in order to protect an area in the body of water or abutting the body of water from waterborne craft. The protection apparatus also includes a plurality of connectors respectively provided between adjacently-positioned ones of the barrier units positioned side-by-side. Each of the connectors includes a tensile member and a dampening member.

According to still yet another embodiment of the invention, there is provided a pontoon for providing buoyancy for a protection barrier to be provided in a body of water. The pontoon includes a metal structural member. The pontoon also includes a urethane inner shell that encases a portion of the metal structural member. The pontoon further includes a polyethylene region that encases the urethane inner shell. The pontoon still further includes a polyurethane elastomer or polyurea outer shell that encases the polyethylene region. A portion of the metal structural member extends out from the outer shell to thereby couple to a portion of the protection barrier.

According to another embodiment of the invention, there is provided a method of protecting a region either in a body of water or adjacent to the body of water. The method includes constructing a composite-based durable barrier structure, the barrier structure configured to hold a net in place, wherein the barrier structure includes a plurality of composite barrier units connected together via connectors. The method also includes placing the composite barrier structure in the body of water, to thereby provide protection for the region.

According to yet another embodiment of the invention, there is provided a winch gate for a protection barrier system provided in a body of water. The winch gate is preferably battery operated and solar charged. The winch gate includes a winch containing a length of wire wrapped around a spool. The winch gates also includes a metal fair lead that is disposed adjacent to the winch and that is positioned so as to accept the wire when the winch is controlled to unspool the wire from the spool. The winch gate further includes a hook coupled to an end of the wire and configured to be coupled to a chain that is itself coupled to a protection barrier module of the protection barrier system. When the which is controlled to spool the wire back onto the spool after the winch was controlled to unspool the wire from the spool and after the wire has been coupled to the chain, the chain is pulled through the metal fair lead and thereby onto the winch gate, to thereby allow the chain to be affixed to the winch gate.

BRIEF DESCRIPTION OF THE DRAWINGS

The foregoing advantages and features of the invention will become apparent upon reference to the following detailed description and the accompanying drawings, of which.

DETAILED DESCRIPTION OF SPECIFIC EMBODIMENTS

The present invention will be described in detail below, with reference to the accompanying drawings. The present invention is directed to a composite harbor protection barrier system (HPB), which is a floating harbor protection barrier system that provides protection to military and commercial harbors or other types of land or water regions from high speed surface boat attacks and other types of surface attacks made by waterborne craft and hovercraft.

The HPB according to at least one embodiment is fabricated out of composite materials for practically all of the portion of the protection barrier structure that is disposed above the water line, and it is constructed primarily out of foam materials for the pontoon structure that floats on the water and that provides the structural capability for each HPB protection barrier unit to float on the water. The HPB is designed to have a low life cycle maintenance cost as compared to conventional structures, while at the same time it is designed to provide an acceptable boat stopping capability to protect military and/or commercial harbors or other types of regions that abut a body of water (or to protect a water region or a land region totally surrounded by water).

The HPB can also be used to protect a structure surrounded by a body of water, such as an off-shore oil platform, by providing protection barriers on the perimeter of the region-to-be-protected. In a preferred implementation, the HPB system is made up of individual 50-foot long protection barrier units connected together in spans to block access to a particular region by unauthorized watercraft. The connection device that connects adjacent 50-foot long protection barrier units to each other is called a connector, and will be described in more detail in a later portion of this application.

Figure 1:
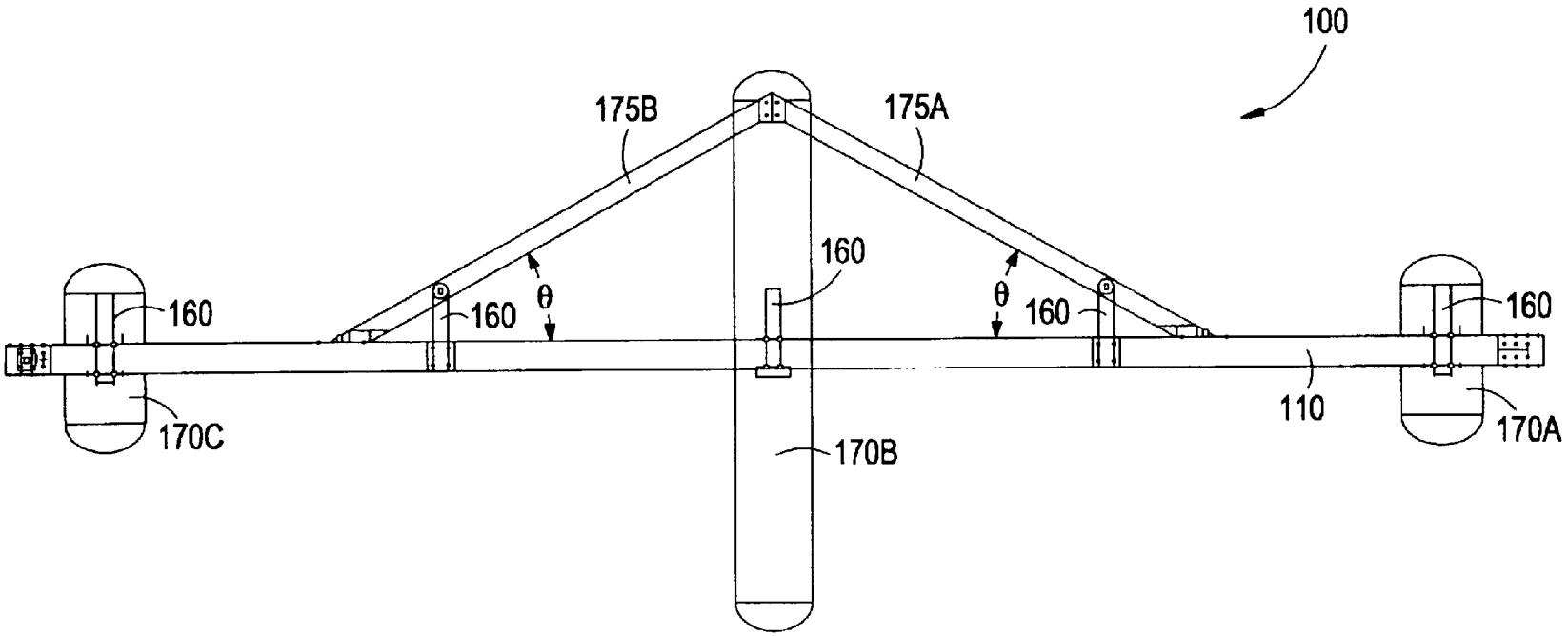
FIG. 1 is a top view of a harbor protection barrier according to a first embodiment of the invention.
Figure 2:
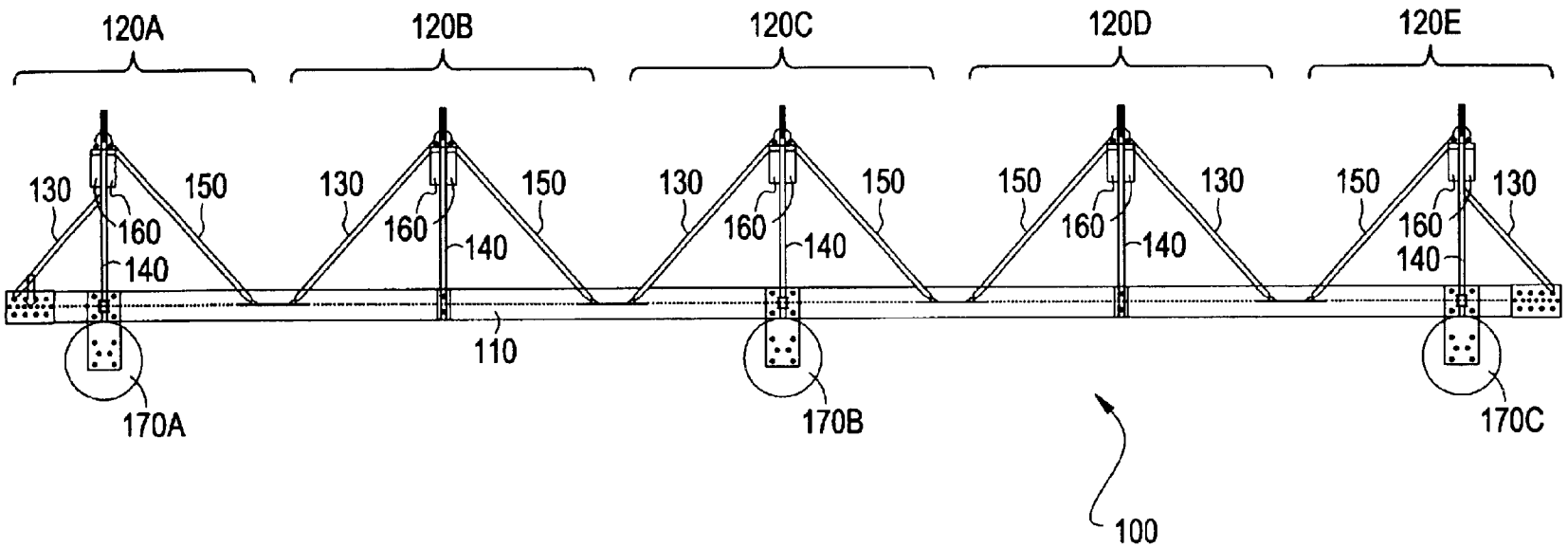
FIG. 2 is a side view of a harbor protection barrier according to the first embodiment of the invention.
Figure 3:
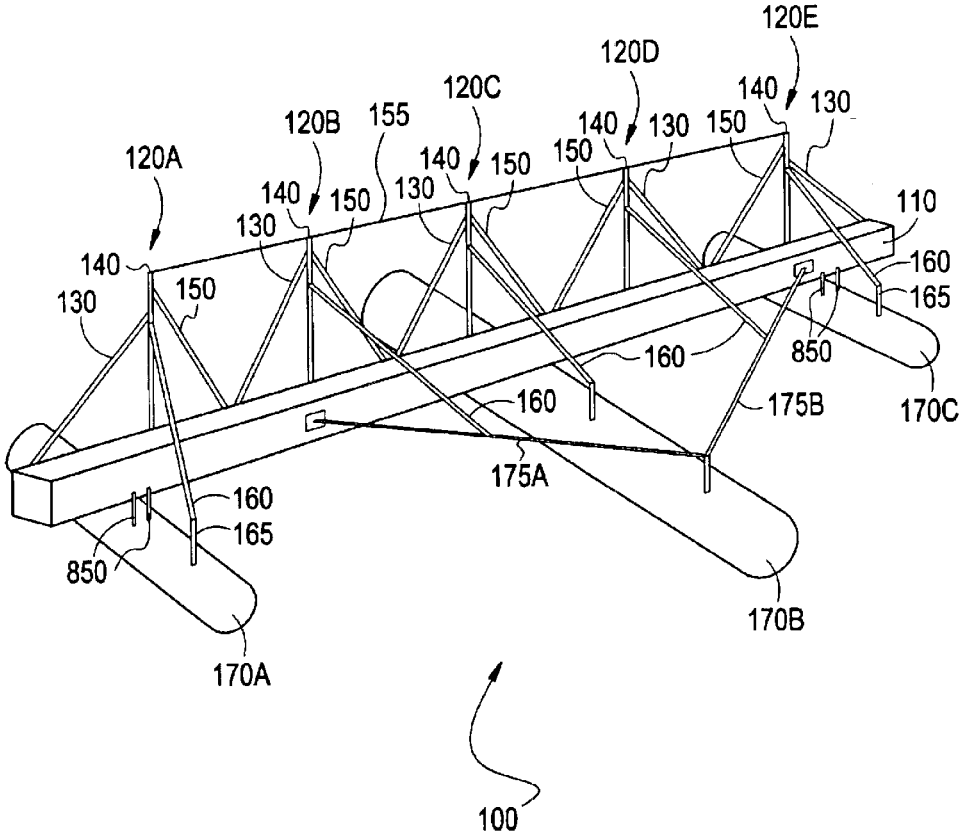
FIG. 3 is a top perspective view of a harbor protection barrier according to the first embodiment of the invention.

The HPB according to a first embodiment of the invention is made up of individual protection barrier units, such as the one shown in FIG. 1 (top view), FIG. 2 (side view) and in FIG. 3 (top perspective view). The part of the HPB that does not float in the water is made up primarily of composite materials such as pultruded fiberglass reinforced plastics (FRP) that have structural properties that are comparable to steel.

The HPB system also uses a novel structure to provide buoyancy for the individual protection barrier unit, by way of foam-filled pontoons. Each pontoon is preferably cylindrical in shape (a rectangular construction of the pontoons is possible in an alternative configuration) and is preferably 28 inches in diameter, whereby each pontoon is constructed out of solid urethane (constituting the core of the pontoon) and polyethylene provided around the urethane core (where the polyethylene is preferably obtained in flexible rectangular sheets and then fitted over the urethane core) to form a polyethylene layer, with an outer shell of high strength polyurethane elastomer that is formed around the polyethylene layer (where the polyurethane elastomer is preferably spray coated onto the pontoon). Woven nylon tire cord can be added to the outer shell in an alternative configuration, but with the currently available structural properties of polyurethane elastomer, such a use of tire cord is not necessary to provide for a sufficiently sturdy outer skin structure for the pontoons.

A steel structural member is encased within the solid urethane inner core of each pontoon. The steel structural member is preferably made of galvanized steel, and whereby the steel structural member is utilized to rigidly connect to a FRP channel that connects to the respective portion of the 50 foot long I-beam (also referred to herein as the "boom") to the pontoon (by way of bolts, for example). The pontoon is also connected to an FRP square beam that couples certain stantions and braces (which are affixed to the boom) to the pontoon. As shown best in FIG. 3 and FIG. 8, the FRP structural member 850 extends upwards (and out of the pontoon's cylindrical shell) from a middle portion of the pontoon 170, and is the portion 170 of the pontoon that the boom 110 is coupled to.

The barrier netting used in the preferred embodiment is a Nylon netting, but other types of netting may be utilized with the HPB according to the invention. For example, the HPB can be used with a conventional 1.125 inch diameter nylon 12-plait line netting, as described earlier. The preferred net is a nylon 50,000 braid net with 6" mesh. The net has a knotless construction that evenly distributes to load horizontally and vertically. The net is primarily nylon with spectra reinforcement at high energy contact areas.

In the preferred embodiment, the net has at least a 170,000 lb. breakage strength. When deployed on an HPB, the bottom portion of the netting is preferably one and one-half to two feet about the water line, and the top portion of the netting is preferably eight feet about the water line. Other distances may be contemplated while remaining within the scope of the invention, to suit a particular water region and a particular type of waterborne threat to be thwarted.

A mooring system is typically utilized with a protection barrier system, and it is designed to hold the protection barrier system in place in a region of water. A mooring system is preferably site-specific, and the type of mooring system used depends on the depth of water, the type of water floor at the installation site, the tides. In that regard, the mooring system is preferably custom designed to fit a particular application. In the preferred embodiment, the mooring system includes one or more foam buoys, 1¾ inch thick chain (with a length depending upon the depth of the body of water), and concrete high efficiency anchors or sinkers (with the chain coupling the buoys to the anchors). The anchors are typically 10 ton or 20 ton solid components that rest on the floor of the body of water.

Turning now to FIGS. 1, 2 and 3, the various components making up an HPB according to the first embodiment will be described in detail. Most of the HPB, excluding the pontoons (which are made primarily out of foam materials), is made of pultruded fiberglass reinforced plastic (FRP) material. The FRP components are estimated to have an operational life of over 20 years with minor maintenance, which is much greater than what is achievable by conventional harbor protection barriers. Besides FRP, other types of composite materials that may be utilized for the various components of an HPB according to the present invention include: foam filled (where appropriate) pultruded plastics, blow molded plastics, compression molded plastics, extruded plastics, carbon fiber reinforced plastics, Kevlar reinforced plastics, urethanes, ureas, high density polyethylene.

FRP structural components have strength properties comparable to steel. The compressive, flexural and tensile strengths of FRP are approximately 30,000 psi. The modulus of elasticity of FRP is approximately $2.6\times10^6$, or about one-tenth that of steel. In other word, FRP is more flexible than steel but of comparable strength, which are desirable features for a harbor protection barrier.

The HBP according to the first embodiment is made up of a plurality of common FRP structural shapes, also referred to as "protection barrier units". Each protection barrier unit 100 is made up of a main structural beam 110, which in the preferred embodiment corresponds to a 12" wide×12" high× ½" thick flange beam (or "I-beam" or "boom"), which extends 50 feet in length (in an alternative configuration, the harbor barrier is 40 feet long, whereby other lengths may be contemplated while remaining within the scope of the invention). In the preferred embodiment, the vertical components of the protection barrier unit 100 that are connected to the boom 110 are 2"×2" solid and hollow square FRP beams. In the preferred embodiment, the horizontal braces that are connected to the boom 110 are 8"×4"×¾" FRP I-beams. One of ordinary skill in the art will recognize that different sizes of I-beams, vertical stantions and angular braces may be contemplated while remaining within the scope of the invention, with the proviso being that these components are FRP composite structures. The various FRP components making up each HBP barrier are preferably attached to each other using bolted stainless steel mechanical connections, chemical adhesive resin connections, rivet connections, or by welding them to each other.

The protection barrier module 100 according to the first embodiment is preferably 50 feet in length (other lengths may be contemplated, while remaining within the scope of the invention), and includes a 50 foot long flange beam (or "boom") 110 as the main non-floating-on-water support for the protection barrier module 100. The boom 110 is rigidly coupled (by way of bolts, welding, riveting, or other type of rigid coupling) to three pontoons 170A, 170B, 170C, whereby end pontoons 170A and 170C are of a same length and whereby middle pontoon 170B is of a longer length (but same diameter) as compared to the end pontoons 170A and 170C. In the preferred embodiment, the end pontoons 170A and 170C are 6 feet long, and middle pontoon 170B is 16 feet long. Other lengths for the pontoons may be utilized whereby the middle pontoon 170B is preferably longer than the end pontoons 170A and 170C, while remaining within the scope of the invention. Pontoons with prismatic, square, and rectangular cross sections instead of circular sections also remain with the scope of the invention. The total weight of each pontoon 170 is approximately 4000 pounds in the preferred embodiment, and each one provides 1000 pounds of buoyancy at a draft of less than 17 inches.

In a preferred implementation, each protection barrier module 100 has five (5) separate supports 120A–120E equally spaced apart from each other above the boom 110, whereby the middle three supports 120B, 120C and 120D have the same structural shape, and whereby the two boom end supports 120A and 120E have a slightly different structural shape as compared to the middle three supports 120B, 120C and 120D. Each of the supports 120A–E includes an outboard lateral brace 130 for providing support for the net stantion 140 that it is coupled to. The outboard lateral brace 130 provides stability for the net stantion along the longitudinal axis of the boom 110, in a direction towards a closest end of the boom 110. The bottom end of the outboard lateral brace 130 is affixed (e.g., bolted or riveted or welded) to the boom 110 (preferably on a side surface of the boom 110), and the upper end of the outboard lateral brace 130 is affixed to its respective net stantion 140.

The net stantion 140 provides the structural component for holding the net up in place on the portion of the protection barrier module 100 where the support is positioned. The net stantion 140 extends upwards from the boom 110, and is affixed to the boom 110 at the bottom end of the net stantion 140, with this affixing preferably being made on a side surface of the boom 110.

One structural difference between the two boom end supports 120A and 120E and the middle three supports 120B, 120C and 120D is that the outboard lateral brace 130 for the two boom end supports 120A and 120E connects to the net stantion 140 at a position lower on the net stantion 140 (about ½ way up the net stantion 140) than where it is connected to the net stantion 140 for the middle three supports 120B, 120C and 120D.

In the preferred embodiment, the net stantions 140 for the two boom end supports 120A, 120E are bolted in place at a distance of 3' 3" from the respective ends of the boom 110, and the outboard lateral brace 140 is angled at 47.5 degrees with respect to the boom (other distances and angles may be contemplated while remaining within the scope of the invention). Due to this construction, the outboard lateral braces 130 for the two boom end supports 120A and 120E couple to a mid-point of their respective net stantions 140 as opposed to being coupled to a top part of their respective net stantions 140, with this difference being due primarily to space limitations at the respective ends of the boom 110.

The first embodiment provides for net stantions located closer to the ends of the boom than what is provided for conventional protection barriers. One reason why net stantions are not placed as close to the ends of the individual protection barriers for conventional barrier units is that the connector used to couple adjacent conventional protection barrier units to each other allows for a lot movement of the individual conventional protection barrier units, and thus the possibility of damage to end supports caused by adjacent conventional protection barrier units contacting these supports during severe weather conditions is a real possibility for conventional protection barrier systems.

Another reason why net stantions are not placed close to the ends of the convention protection barrier units is due to the rigidity of the steel (that makes up a vast majority of the components of the conventional protection barrier units) that does not provide any flexibility which could provide for dissipation of forces applied to the barrier units.

The HBP according to the present invention preferably utilizes a connector that has both tensile characteristics and dampening characteristics, whereby its' flexibility provides for dampening motions of adjacent protection barrier units that the connector is coupled to. With the use of such a connector, the possibility of adjacently-connected protection barrier units 100 coming into contact with each other is greatly minimized, if not eliminated, whereby strong wave forces are dampened among the many protection barrier units 100 of a protection barrier system that are coupled together by way of connectors.

Due in part to the use of novel connectors to be described in more detail below (with respect to a second embodiment or a third embodiment of the invention), the present invention according to the first embodiment provides end boom stantions 120A and 120E close to the ends of the boom 110, to thereby provide strong support for the net at all places along the boom 110. This added feature is not possible with the conventional protection barrier units.

Also, due in part to the use of flexible FRP materials for many components of the protection barrier module 100, the end boom stantions 120A and 120E can be placed very close to the ends of the boom 110, since the flexible nature of the FRP provides for some amount of dissipation of forces applied to the protection barrier module 100.

Each of the five supports 120A–E also includes an inboard lateral brace 150, which for the middle three supports 120B, 120C and 120D is positioned from their respective net stantion 140 in an opposite manner as compared to their respective outboard lateral brace 130. Therefore, for the middle three supports 120B, 120C and 120D, the inboard lateral brace 130 connects to its respective net stantion 140 at a same height on the net stantion 140, and for the two end boom supports 120A and 120E the inboard lateral brace 150 connects to its respective net stantion 140 at a top portion on the net stantion 140 (corresponding to a same height as where it is connected for the middle three supports 120B, 120C and 120D).

At a top-most portion of the net stantions 140 for the middle three supports 120B, 120C and 120D, a through-hole is provided through which a cord 155 is fitted therethrough (see FIG. 3, for example), whereby the cord 155 spans an entire length of the boom 110. The cord 155 is utilized to hold a top end of the net in place on the protection barrier module 100, whereby the ends of the cord 155 are coupled to the respective net stantions 140 of the two end boom supports 120A and 120E. In the preferred embodiment, the net stantions 140 for the two boom end supports 120A and 120E have a turnbuckle (not shown) at the top-most portion thereof, whereby the cord 155 is coupled to the turnbuckles to allow the cord 155 to be tightened or loosened, as required, in order to hold the net in place at a particular tension on the protection barrier module 100.

Each of the five supports 120A–E also includes a friendly-side support 160 that provides stability in a direction perpendicular to the net. For each of the two end boom supports 120A and 120E, the top end of its friendly-side support 150 is connected to a top-portion of its vertical stantion 140, and the bottom end of its friendly side support 150 is connected to a post 165 that extends from a friendly-side part of the small pontoon 170A, 170C disposed below it. For each of two of the middle supports 120B and 120D that are adjacent to the respective end boom supports 120A and 120E, the bottom end of its friendly-side support 160 is connected to a first beam 175A or to a second beam 175B of a V-frame structure, and the top end of its friendly-side support 160 is connected to a top portion of its respective vertical stantion 140. For the middle support 120C that is disposed at the middle of the boom 110, the bottom end of its friendly-side support 160 is connected to a friendly-side portion of the long pontoon 170B disposed beneath it, and the top end of its friendly-side support 160 is connected to a top portion of its respective vertical stantion 140.

In the preferred embodiment, the friendly-side support 160 is a dual-FRB-beam structure (see FIG. 2 in particular), with the dual beams being positioned in parallel to each other with a cross beam rigidly coupling them together at the central portion of the beams. The distance between the dual beams is approximately the same as the diameter of the vertical stantion 140 (e.g., a few inches in diameter).

As discussed above, each protection barrier module 100 also includes a V-shaped support on a friendly side of the protection barrier module 100. In more detail, the V-shaped support includes a first beam 175A that has one end that is bolted to a "friendly" side of the boom 110 and that extends at an angle θ from the boom in a direction towards the center of the boom 110, and a second beam 175B that has one end that is bolted to the friendly side of the boom 110 and that extends at an angle θ from the boom 110 in a direction towards the center of the boom 110.

In the preferred embodiment, θ is equal to 28 degrees (whereby other angular dispositions are possible while remaining within the scope of the invention). In the preferred embodiment, the other ends of the first and second beams 175A, 175B meet at a point approximately 8 feet apart from the boom 110 on the friendly side of the boom 110, and are bolted to each other to thereby form a "V" shape.

The V-shaped support provides stability to protect the joint that connects the long pontoon 170B with the boom 110, and it also takes the twisting load of the long pontoon 170B and dissipates that load, so as to not cause damage to the protection barrier module 100 due to sudden movements of the long pontoon 170B resulting from severe weather conditions (e.g., high waves) or the like. Further, the V-shaped support operates to keep the protection barrier module 100 in an upright position even when the protection barrier module 100 is hit from the threat side by a fast-moving watercraft. The V-shaped support helps keep the protection barrier module 100 upright by giving it a larger "base" than what it would have if the V-shaped support was not provided.

Preferably, all of the fasteners that are used to connect the various FRP components of the protection barrier module 100 to each other are via stainless steel bolts or other types of stainless steel fasteners. Other ways of connecting these components to each other may be contemplated, such as by welding or riveting.

Compared to conventional steel protection barrier modules, the FRP according to the first embodiment provides a lighter design due to the use of FRP components, which makes it more stable as well. The pontoons 170A, 170B and 170C utilized in the first embodiment are of a similar weight to the pontoons used in the conventional steel protection barrier modules, but due to the lighter-weight boom structure, the center of gravity of each 50-foot long protection barrier module 100 is lower than the center of gravity for conventional protection barrier modules. With a lower center of gravity, there is a lesser likelihood that the protection barrier module 100 according to the first embodiment will overturn or list heavily in severe weather conditions, as compared to a higher center of gravity of a conventional protection barrier module. Also, the lighter weight of the protection barrier module 100 according to the first embodiment gives it a more stable structure.

A typical region in the water or abutting the water requires more than one 50-foot long protection barrier module to protect the entire region. Accordingly, a plurality of 50-foot long protection barrier modules are coupled together to form a longer protection barrier structure. As mentioned earlier, the conventional protection barrier structures have connectors that provide a loose coupling of each protection barrier module to its adjacent protection barrier module. Basically, each conventional protection barrier module is coupled to its adjacent protection barrier module by way of a chain, whereby the chain corresponds to the convention connector. The inventors of this application have determined that this results in an undesirable structure, and can result in damage and/or overturning of individual protection barrier modules during severe weather conditions. As a result, an area to be protected may be compromised if one or more harbor protection barriers overturn or are otherwise damaged due to weather conditions.

Figure 4A:
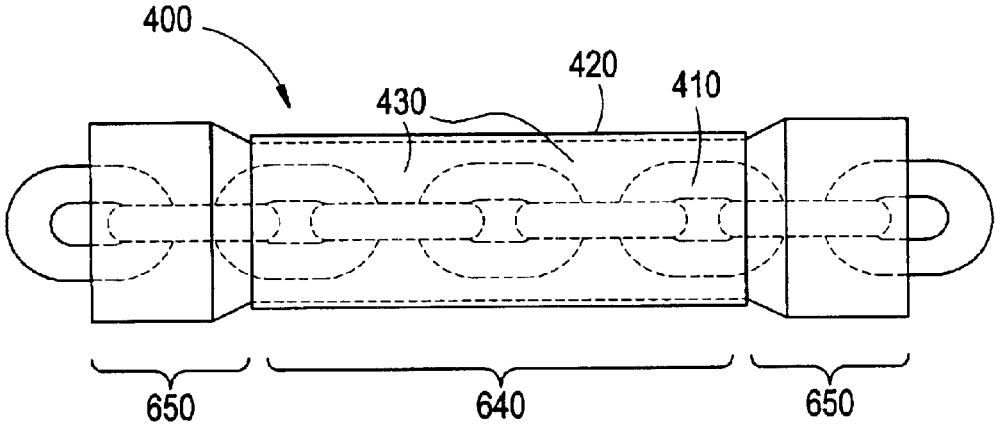
FIG. 4A is a side view of a connector according to a second embodiment of the invention.
Figure 4B:
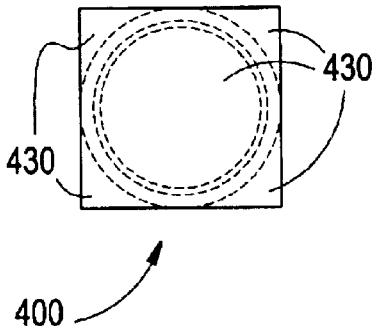
FIG. 4B is a front (or back) view of a connector according to the second embodiment of the invention.
Figure 5A:
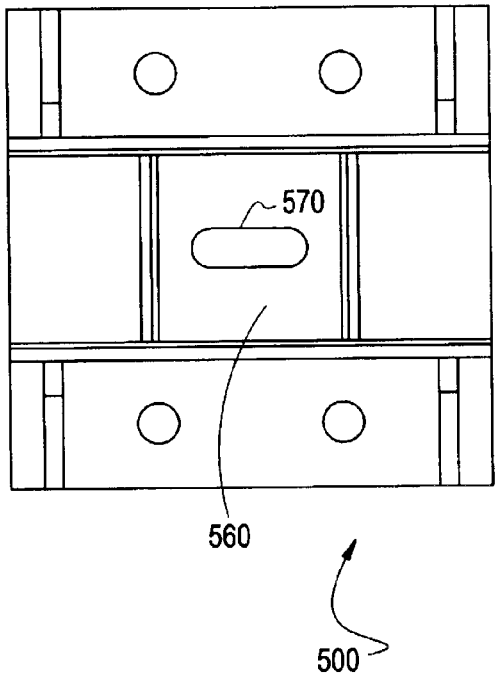
FIG. 5A is a front view of a bracket used to connect a connector to a harbor protection barrier, according to an embodiment of the invention.
Figure 5B:
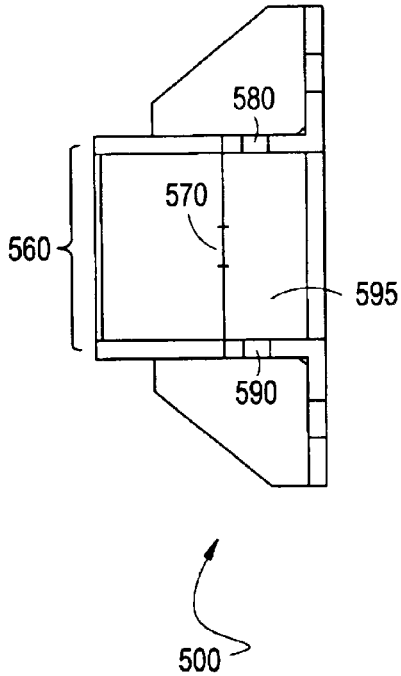
FIG. 5B is a side view of a bracket used to connect a connector to a harbor protection barrier, according to an embodiment of the invention.

In this regard, a connector 400 according to a second embodiment of the invention has been developed. FIG. 4A is a block diagram of a side view of a connector 400 according to the second embodiment, FIG. 4B is a block diagram of a front view (or back view) of the connector 400. FIG. 5A is a block diagram of a front view of a bracket 500 that is configured to be bolted an end of a boom 110 (one bracket 500 bolted on each end of the boom 110, with four bolt holes shown in FIG. 5A), and which is used to couple the connector 400 to adjacent protection barrier modules and thereby couple the adjacent protection barrier modules to each other. FIG. 5B is a side view of the bracket 500.

Figure 6:
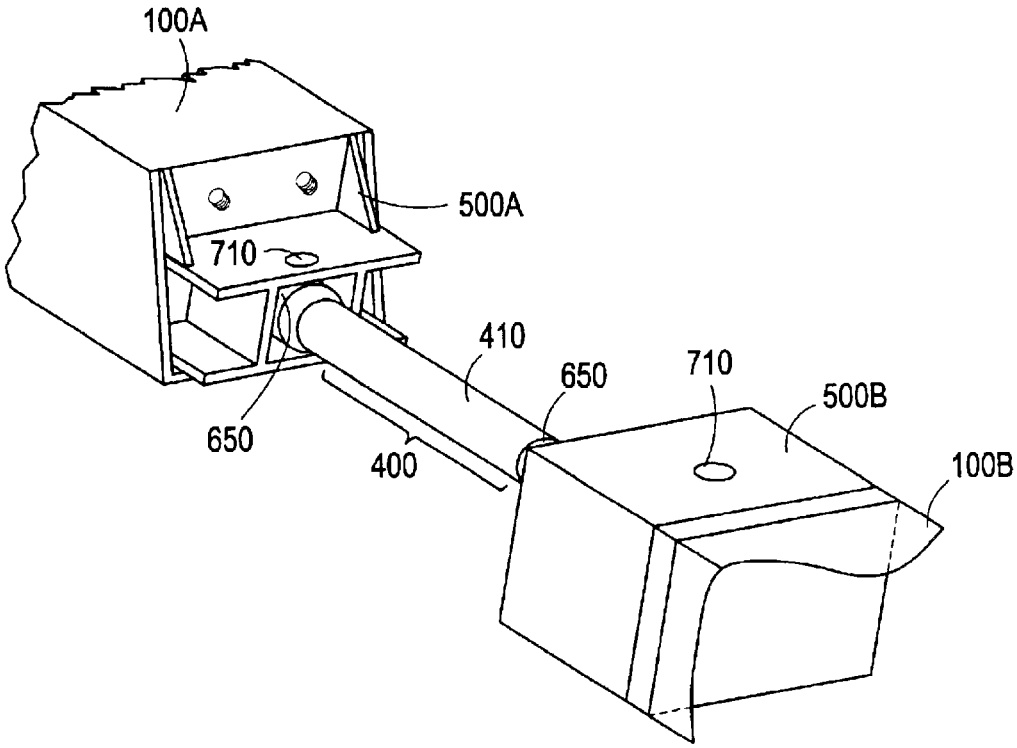
FIG. 6 is a plan view showing a connector being used to connect adjacently-positioned harbor protection barriers, according to an embodiment of the invention.

FIG. 6 is a plan view showing a connector 400 being connected to two brackets 500A, 500B, with one bracket 500A coupled to a first protection barrier module 100A (only the end part of it is shown in FIG. 6) and with one bracket 500B coupled to a second protection barrier module 100B (only the end part of it is shown in FIG. 6) that is adjacently positioned with respect to the first protection barrier module 100A.

Figure 7:
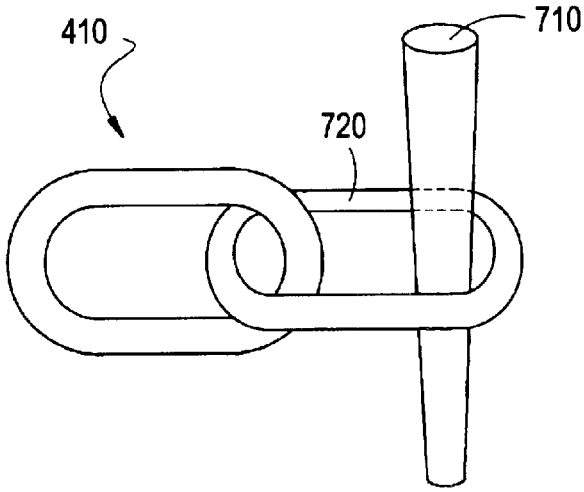
FIG. 7 is a diagram showing a tapered pin being used to hold an end link of a cable (part of a connector)-in place within a bracket, according to an embodiment of the invention.

FIG. 7 shows a tapered pin 710 being used to hold a chain link 720 (end part of a chain used in the connector 400) in place on a bracket 500.

The connector 400 according to the second embodiment includes a urethane-encapsulated chain section 410 that has its ends secured to the booms 110 of adjacent protection barrier modules 100 by way of the respective bracket 500 coupled to each of the booms 110. An alternate method for achieving the dampening effect is with the use of a rubber or elastomeric hose, friction clamped to the connector housing, thereby creating a symmetric shroud around the chain or other tension member. In the preferred embodiment, the connector 400 provides a connection strength of approximately 136,000 pounds (whereby the connection strength varies with the size of chain encased in the urethane) with an elastic nature that "dampens" forces that could otherwise cause high impact collisions between adjacent protection barrier modules 100. The connector can be scaled up or down in sized depending on the specific design environmental loads at the site. The utilization of one or more connectors 400 according to the second embodiment provides for a multi-protection barrier module structure (e.g., ten 50-foot long protection barrier modules 100 connected together by way of nine connectors 400 to form a 500-foot long protection barrier structure) that acts as a continuous unit that responds in a flexible way to changing water states (e.g., high winds, high winds and high waves, etc.).

The connector 400 according to the second embodiment operates as a dampener with respect to the two adjacent floating protection barrier modules 100 that it couples together. The connector 400 includes combined tensile and dampening materials working together as a single unit. The tensile material is a chain 110 in a preferred construction, but it could also be a cable, wire, rope, structural steel, or synthetic line.

In the preferred embodiment, the dampening material includes a rubber hose 420 and molded polyurethane 430, but it could also be a similar natural or synthetic material (e.g., other type of polymer instead of polyurethane with similar properties) configured to: a) carry connector tension during low load conditions, and b) transfer load to the tensile member during high load periods, and/or c) dampen motion from one protection barrier unit to an adjacent protection barrier unit as the protection barrier system is subject to wave motion or other forces. The rubber hose is 420 is preferably cylindrical in shape and is ⅜ inches thick (other thicknesses are possible while remaining within the scope of the invention).

A method of constructing the connector 400 according to the second embodiment will be described below. First, a mold is created for the connector 400, whereby the mold has a cylindrical middle portion 640 (one foot long in the preferred embodiment) and square-shaped outer portions 650 (each three inches long in the preferred embodiment, with a one inch long transition portion adjacent to the middle portion 640). The mold forms the shape of the outer dimensions of the connector 400. The square-shaped outer portions 650 are configured to fit snugly within equal-sized square-shaped receptacle portions 560 of the brackets 500 mounted to the booms 110, so as to allow only a very small amount of turning or rotation of the connectors 400 with respect to the brackets 500 that the connectors 400 are coupled to. The connector according to at least one embodiment of the present invention includes all urethane encased chain or tensile members of varying geometries (including but not limited to a square block, a rectangular block, etc.)

The chain 410 is placed down the hollow middle portion of the mold, and then the mold is filled with polyurethane and is then allowed to cure. When the polyurethane has finished curing inside the mold to thereby form a polyurethane mold 430, a connector structure with a polyurethane-encased chain 410 that passes through the middle of the connector 400 is provided. As seen in FIG. 4A, the end links of the chain 410 extend out from the polyurethane mold 430 such that about one-half (½) of the end link of the chain 410 on each end of the chain 410 is not encased by the polyurethane mold 430.

A rubber hose 420 is fitted around the cylindrical middle portion 640 of the mold 430, preferably prior to the polyurethane being inserted into the mold. The rubber hose 420 functions as a protective sleeve for the polyurethane mold 430. The rubber hose 420 also functions as an extra dampening material (along with the polyurethane mold 430) for the connector 400, as well as acting as a protection skin for the polyurethane mold 430 that is disposed in the interior region of the connector 400 (completely encasing the chain 410 in the middle portion 640 of the connector 400). For example, without the rubber hose 430 provided as the exterior surface or "skin" of the connector 400, the possibility of banging of composite FRP parts of adjacent protection barrier units 100 may occur, which could result in the creation of cracks in the polyurethane mold 430, which would diminish the dampening properties of the connector 400.

Referring to FIGS. 5A, 5B and 6, the square-shaped receptacle portion 560 of the bracket 500 has a slot 570 which is sized to as to receive the half-link of the chain 410 that extends out from a respective end of a connector 400 that is to be fitted snugly into the square-shaped receptacle portion 560 of the bracket 500.

After the end link of the chain 410 is fitted through the slot 570, a tapered pin 710 is tamped down from a hole 580 in a top wall of the square-shaped receptacle portion 560 of the bracket 500 to fit snugly into a hole 590 in a bottom wall of the square-shaped middle portion of the bracket 500. As a result, the chain 410 (and thereby the ends of the connector 400) is firmly coupled to the bracket 500, whereby the chain 410 is under constant tension. Thereby, a tensile load applied to the connector 400 is transferred to the connector 400 (and dissipated to some extent) via the chain 410, without materially effecting the rubber hose 420 or the polyurethane mold 430. With this done on both ends of the connector 400, the connector 400 provides for a strong coupling of adjacent protection barrier units 100A and 100B as seen in FIG. 6, while at the same time allowing for dampening of forces caused by strong waves, threat boats, or the like. The dampening of forces lessens the likelihood that strong forces affecting one protection barrier module will affect adjacent protection barrier modules, and also it provides a mechanism to dampen the forces on one or more protection barrier modules to be absorbed by the entire protection barrier system (which may be made up of 50 protection barrier modules 100 connected together via 49 connectors 400, for example).

The use of a tapered pin 710 to couple the connector 400 to the bracket 500 is preferable in order to reduce any possibility of rattling of the connector 400 due to a loose connection of the connector 400 to the bracket 500 that may otherwise occur if a non-tapered pin is used instead. FIG. 7 shows a tapered pin 710 that is fitted through an end link 720 of the chain 410. Other components of the connector 400 and the bracket 500 are not shown in FIG. 7 to provide clarity for showing how the tapered pin 710 is utilized in the present invention.

FIG. 5B shows a side view of the bracket 500, whereby the upper and lower holes 580, 590 in which the tapered pin 710 is fitted through are shown, and whereby the tapered pin 710 holds the end link of the chain 410 in place in a back region 595 of the bracket 500. The tapered pin 710 can be welded in place on the bracket 500, if desired, to provide a rigid connection of the connector 400 to the boom 100 (via the bracket 500).

By having a connector with a rubber hose exterior surface and with a polyurethane mold disposed around a chain, the possibility of adjacent protection barrier units crashing into each other during severe weather conditions is decreased as compared to conventional protection barrier connectors. In more detail, the polyurethane mold 430 and the rubber hose 420 of the connector 400 provide a measure of stiffness to the connector 400 to allow some limited amount of movement of barrier units due to waves or the like, as well as to provide for a dampening of forces exerted on a protection barrier module 100 that is coupled to the connector 400.

In a preferred construction of the second embodiment, the square-shaped outer portions 650 of the connector are 5"×5" in size, which is slightly smaller in size than the square-shaped receptacle portion 560 of the bracket 500 that the square-shaped outer portions 650 of the connector 400 are respectively fitted into. As explained earlier, this size match is to ensure that rotational movements of the connector 400 with respect to the brackets 500 (and thus to the booms 110 of the two protection barrier units 100 that the connector 400 couples together) does not occur to any measurable extent.

In a third embodiment, a connector has a structure similar to that described above with respect to the second embodiment, but where no polyurethane mold is utilized. In the third embodiment, the connector has a cylindrical shape with a rubber hose providing an exterior surface of the connector, and where a chain is fitted inside of the rubber hose, and where the chain connects at its respective ends with adjacent protection barrier units. In the third embodiment, the rubber hose provides for the dampening of forces applied to the connector by way of the protection barrier units, and the chain provides for the handling of tensile forces applied to the connector. Although the third embodiment is not as good as the second embodiment in terms of dampening forces applied to a protection barrier system, it may be suitable for situations whereby cost is a factor (the connector according to the third embodiment is cheaper to make than the connector according to the second embodiment) and/or where the environmental conditions are such that it is suitable to handle the wave conditions.

Figure 8:
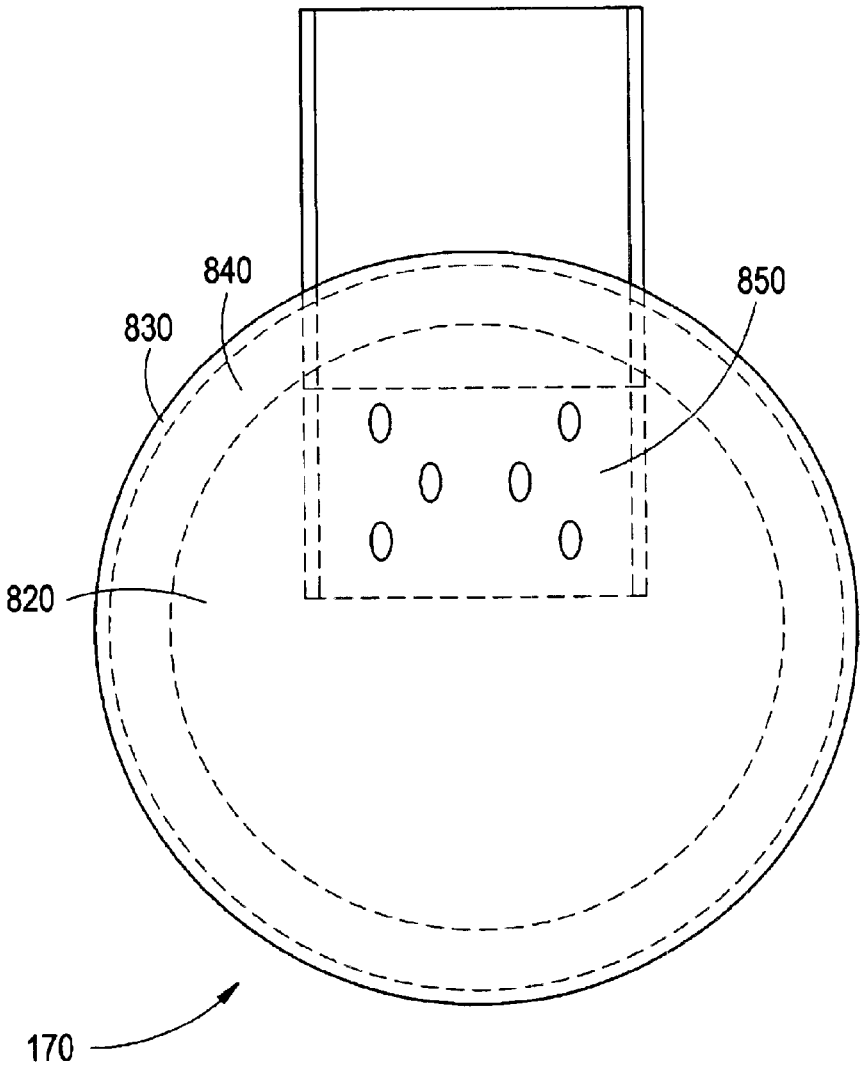
FIG. 8 is a diagram showing the make-up of a pontoon according to a fourth embodiment of the invention.

As described in some detail earlier, the HPB system according to the present invention uses a novel pontoon structure to provide buoyancy for the individual protection barrier unit, whereby the pontoon structure corresponds to a fourth embodiment of the invention, as shown in FIG. 8. The pontoon 170 is preferably cylindrical in shape (a rectangular construction of the pontoons is utilized in an alternative configuration) and is preferably 28 inches in diameter, whereby each pontoon 170 has a solid urethane core 820 with a portion of a galvanized steel structure 850 also disposed therein. These two components form the inner shell of the pontoon 170. Polyethylene sheets are provided around the inner shell to thereby form a polyethylene ring 840 around the inner shell, whereby each sheet is preferably a rectangular sheet that can be readily obtained commercially. An outer shell of high strength polyurethane elastomer 830 is then formed around the polyethylene ring 840. In a preferred method of constructing the pontoon 170, the urethane core 820 is a closed cell rigid urethane foam material that is sprayed into the inner shell to thereby surround the galvanized steel structure 850 disposed within the pontoon 170. As an alternative to use of polyurethane elastomer for the outer shell 830, polyurea can be utilized.

FIG. 8 also shows an upper portion of the galvanized steel structure 850 that extends from a top surface of the pontoon 170, and which is used to affix the pontoon 170 to the beam 110. Based on the weight of the pontoon 170 and the FRP protection barrier unit 100, about one-half of the pontoon 170 is disposed above the water line and about one-half of the pontoon 170 is submerged in the water.

Since the outer shell of the pontoon 170 that is in contact with water is not of a steel construction, the problems with conventional steel pontoons due to rusting and the need to paint it very often are not experienced. The outer shell is non-water absorbing, non-marking, and abrasion resistant. An estimated design life of 15 to 20 years for the pontoon 170 is envisioned, with minor maintenance during that time period for the galvanized connections.

The steel structural member 850 of the pontoon 170 is preferably made of hot-dipped galvanized mild steel embedded in the center of the pontoon 170, whereby the structural member 850 provides rigidity to the pontoon 170 and acts to transfer the loads from the FRB composite protection barrier unit 100 that is disposed above the water line, to the pontoon 170. The structural member 850 inside the pontoon 170 preferably has two FRP connection points extending out through the top of the pontoon 170 to thereby connect to the beam 110, and it also preferably has two and pitch braces. The contact of the structural member 170 to dissimilar (FRB) members (e.g., the FRB boom 110) helps prevent corrosion occurring to the structural member 850.

Table A, provided below, lists the estimated weights and buoyancies for a 50 foot long HPB according to one specific implementation of the preferred embodiment of the invention (sized according to specific environmental conditions at a site at which the HPB is to be provided).

TABLE A

| | | |
|---|---|---|
| Pontoon Weight | 2051 | lbs. |
| Boom Structure | 1600 | lbs. |
| Net and hardware weight | 287 | lbs. |
| Connection Allowance weight | 75 | lbs |
| Total Weight | 4013 | lbs. |
| Buoyancy per foot required | 33.8 | lbs/ft. |
| Volume req'd per foot of pontoon in water | .090 | CF |
| Diameter of Pontoon | 8.00 | inches |
| Buoyancy Available with Draft = D/2 | 103 | lbs. |
| Reserve Buoyancy with draft D/2 | 89 | lbs/ft. |
| d = draft | 16.8 | inches |
| D | 28.0 | inches |
| d/D | 0.6 | |
| Area/$D^2$ | 0.492 | |
| Freeboard | 11.2 | inches |
| Area | 2.679 | $ft^2$ |
| Volume | 80.4 | CF |
| Buoyancy available with draft = 0.6*D | 143.0 | lbs. |
| Reserve Buoyancy | 1130 | lbs. |

Figure 9A:
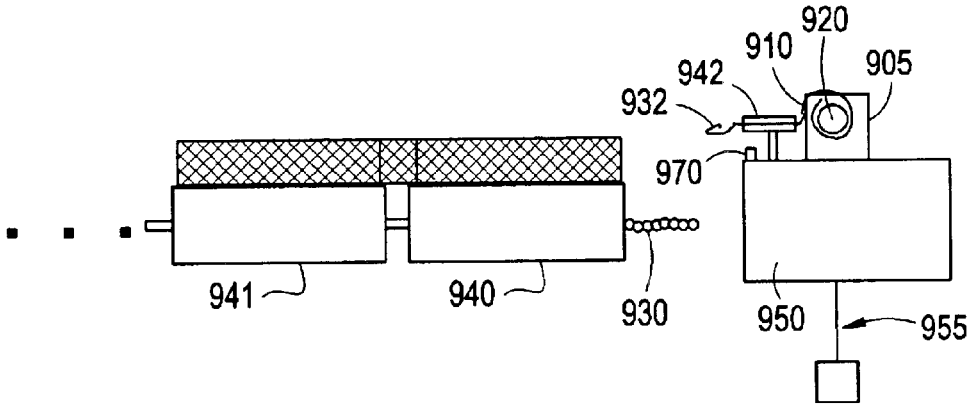
FIGS. 9A–9C show different operational states of a winch gate system according to a fifth embodiment of the invention.
Figure 9B:
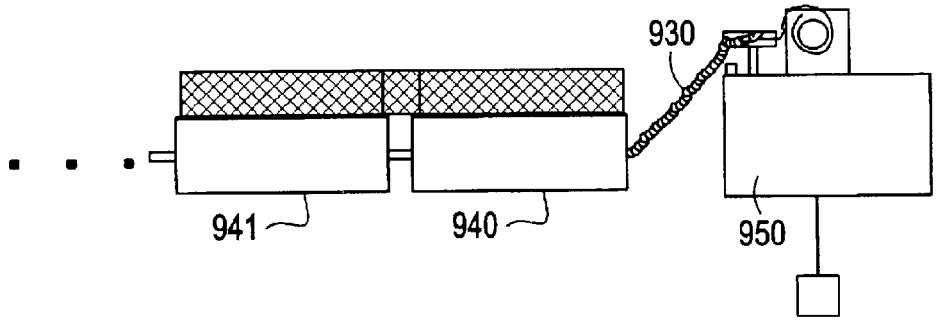
Figure 9C:
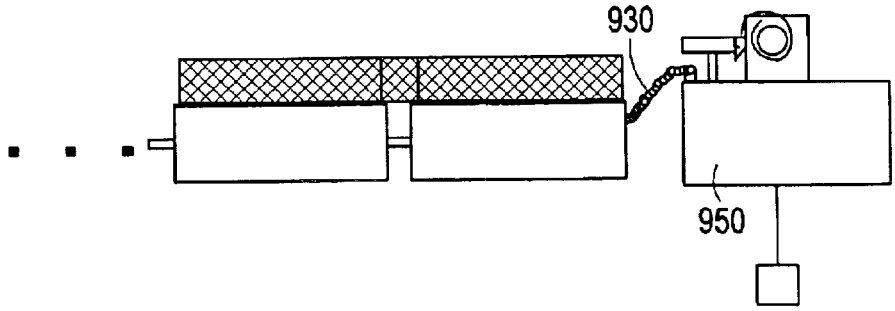

A winch gate system for a harbor protection barrier will now be described, with reference to FIGS. 9A, 9B and 9C. The winch gate system includes a winch 905 that contains a length of wire 910 wound around a spool 920. The winch is preferably electronically controlled, so that the wire 910 is either wound off the spool 920 or wound onto the spool 920 via electronic control. A hook 932, such as a pelican hook, is provided at the end of the wire 910. Conventional winch gates utilize pulleys, which make them impractical to open and close harbor protection gates that have chains (extending from end-unit protection barrier modules) that may get stuck in the pulleys during a gate closing operation.

The winch gate system according to a fifth embodiment of the invention operates to couple to a length of chain 930 extending from an end protection barrier unit 940 (e.g., the end unit of a 50-unit harbor protection barrier system that also includes barrier unit 941 as shown in FIG. 9), pull a portion of the chain 930 through a metal fair lead 942 extending from a gate buoy 950 (that is moored at a particular position in the water via a mooring system 955) by way of operation of the winch 905, and then secure the chain 930 onto a chain hook 960 that is provided on the gate buoy 950. In the preferred embodiment, a solar-charged battery powers the winch 905.

The metal fair lead 942 is a hollow cylindrical unit that extends from the spool 920 to the front edge of the gate buoy 950, whereby the winch wire 910 is fed through the metal fair lead 942 when an electronic "unwind operation" is input to the winch 905, to thereby allow an operator to couple to a length of chain extending from an end protection barrier unit to the wire 910 that now extends out from the distal end of the metal fair lead 942. This is the state of the winch gate system as shown in FIG. 9A.

By way of example and not by way of limitation, for a 15-foot length of chain 930 coupled to and extending out from the end protection barrier unit 940, in order to close a gate of a protection barrier system which includes the end protection barrier unit 940, the end protection barrier unit 940 will be pushed close to the gate buoy 950, such as to a distance 10 to 15 feet away from the gate buoy 950. This can be done by using a boat or other type of watercraft to push or pull the end protection barrier unit 940 close to the gate buoy 950.

As explained above, the winch wire 910 extends out from the metal fair lead 942 by a certain amount. For example, the winch wire can be extended out from the metal fair lead 942 by 5 feet to 15 feet, or to any desired amount, based on electronic operation of the winch 905. The metal fair lead 942 extends from the spool 920 to an outer edge of the gate buoy 950, and the length of the metal fair lead 942 is dependant on that distance (e.g., 2 feet to 5 feet typically). In a preferred implementation, the diameter of the metal fair lead 942 is from 6 to 12 inches.

The metal fair lead 942 is constructed so as to not have any sharp angles along its path, and preferably it is a fairly straight fair lead that has a downward bend at its distal end (to thereby allow the wire to drop downward towards the water line). It is preferably that the downward bend is no more than a 20 degree bend with respect to the (preferably straight) front portion of the metal fair lead 940 that is closest to the spool 920.

With the wire 910 extending from the distal (outer) end of the metal fair lead 942, the pelican hook 932 at the end of the wire 910 is grabbed by an operator and affixed to a chain link on the chain 930 extending from the end protection barrier unit 940.

With the affixing thus made, the winch 905 is electronically operated to reel in the winch wire 910 towards and thereby onto the spool 920. Accordingly, the winch wire 910 is pulled back towards the spool 920, whereby the wire 910 and the chain 930 attached to the wire 910 are pulled into and through the metal fair lead 942 and thereby onto the gate buoy 950, as shown in FIG. 9B. When the "close" operation of the winch 905 is complete, an operator positioned on the gate buoy 950 can readily attach a portion of the chain 930 and hook it onto a chain hook 970 that is rigidly attached to the gate buoy 950, to thereby completely close the harbor protection gate. This "closed" state of the winch gate system is shown in FIG. 9C.

As the winch 905 operates to pull the wire 910 and the chain 930 back through the metal fair lead 942, this acts to pull the end protection barrier unit 940 the last 10 to 15 feet or so to eventually come into close contact with the gate buoy 950. Accordingly, a fairly easy way to close a harbor protection barrier gate (and thereby secure an area in the water or abutting the water) is accomplished.

To open the harbor protection gate, an operator releases the chain 930 from the chain hook 970 on the gate buoy 950, and as such the end protection barrier unit 940 will start moving away from the gate buoy due to water forces (e.g., tide direction, wave motion, etc.). Alternatively, once the chain 930 is released from the chain hook 970, a boat or other type of watercraft can be hooked up to the chain, so as to move the end protection barrier unit 940 sufficiently away from the gate buoy 950 in order to "open the gate" to allow access to the region being protected by the protection barrier system.

Thus, different embodiment of a protection barrier module and a protection barrier connector have been described according to the present invention. Many modifications and variations may be made to the techniques and structures described and illustrated herein without departing from the spirit and scope of the invention. Accordingly, it should be understood that the methods and apparatus described herein are illustrative only and are not limiting upon the scope of the invention. For example, while the first embodiment has been described with respect to five separate supports, other numbers of supports may be utilized, depending upon the length of the boom and the type of threat expected.

What is claimed is:

1. A protection apparatus that is configured to float on a body of water, comprising:

a composite-based durable barrier structure, the barrier structure configured to hold a net in place, wherein the protection apparatus protects an area in the body of water or abutting the body of water from waterborne craft; and at least three pontoons, wherein a first pontoon is coupled to a portion of the barrier structure adjacent to a first end of the barrier structure, wherein a second pontoon is coupled to a portion of the barrier structure adjacent to a second end of the barrier structure, and wherein a third pontoon is coupled to a portion of the barrier structure between the first and second ends of the barrier structure, and wherein the barrier structure comprises:

a beam that is coupled to the first, second and third pontoons, and that extends longitudinally along a direction of the net; and a plurality of net holding members that extend upward from the beam;

a first brace that extends from the third pontoon to a position on the beam that is between the first pontoon and the third pontoon; and a second brace that extends from the third pontoon to a position on the beam that is between the second pontoon and the third pontoon.

2. The protection apparatus according to claim 1, wherein the first and second pontoons are of a first length, and wherein the third pontoon is of a second length greater than the first length.

3. The protection apparatus according to claim 1, wherein the beam spans an entire length of the barrier structure, and wherein the beam is a composite-based structure.

4. The protection apparatus according to claim 3, wherein the beam is in a range of 40 to 50 feet in length.

5. The protection according to claim 1, wherein the composite-based durable barrier structure is a fiberglass reinforced plastic durable barrier structure.

6. A protection apparatus that is configured to float on a body of water, comprising:

a plurality of barrier units positioned side-by-side, each of the barrier units comprising a composite-based durable barrier structure, the barrier structure configured to hold a net in place in order to protect an area in the body of water or abutting the body of water from waterborne craft; and a plurality of connectors respectively provided between adjacently-positioned ones of the barrier units positioned side-by-side, wherein each of the connectors includes a tensile member and a dampening member, wherein each of the plurality of barrier units includes an inverted V-shaped brace that provides additional support for protecting against the waterborne craft from penetrating the protection apparatus, and wherein each of the plurality of barrier units further comprises:

a bracket disposed at each end of the plurality of barrier units, each of the brackets having an opening at a top portion thereof;

wherein each of the connectors further comprises:

a chain link that corresponds to the tensile member; and wherein the protection apparatus further comprises:

a pin that is configured to be placed downward through the opening at the top portion of each of the brackets, to thereby hold the connectors in place against the brackets.

7. The protection apparatus according to claim 6, wherein the pin is configured to fit through an end link of the chain link of the connector.

* * * * *